US011518186B2

(12) United States Patent
Zheng et al.

(10) Patent No.: US 11,518,186 B2
(45) Date of Patent: Dec. 6, 2022

(54) SELF-ADAPTIVE PENCIL FEEDING MECHANISM

(71) Applicant: Ningbo Tianhong Stationery Co., Ltd., Zhejiang (CN)

(72) Inventors: Gaowei Zheng, Zhejiang (CN); Feng Cao, Zhejiang (CN); Junfeng Zhang, Zhejiang (CN); Chongzhi Zheng, Zhejiang (CN)

(73) Assignee: Ningbo Tianhong Stationery Co., Ltd., Ningbo (CN)

( * ) Notice: Subject to any disclaimer, the term of this patent is extended or adjusted under 35 U.S.C. 154(b) by 258 days.

(21) Appl. No.: 16/906,158

(22) Filed: Jun. 19, 2020

(65) Prior Publication Data

US 2021/0197613 A1 Jul. 1, 2021

(30) Foreign Application Priority Data

Dec. 31, 2019 (CN) ..... 201922501256.1

(51) Int. Cl.
*B43L 23/00* (2006.01)

(52) U.S. Cl.
CPC ..... *B43L 23/002* (2013.01)

(58) Field of Classification Search
CPC ..... B43L 23/002
See application file for complete search history.

(56) References Cited

U.S. PATENT DOCUMENTS

2006/0272743 A1* 12/2006 Hu ..... B43L 23/008 144/28.72
2008/0060720 A1* 3/2008 Hu ..... B43L 23/002 144/28.5
2021/0197613 A1* 7/2021 Zheng ..... B43L 23/002

FOREIGN PATENT DOCUMENTS

CN 201922805 U * 8/2011
CN 203331659 U * 12/2013
CN 204222500 U * 3/2015
CN 208359795 U 1/2019
CN 216694404 U * 10/2020
CN 211918221 U * 11/2020
CN 213138337 U * 5/2021
CN 214001147 U * 8/2021
CN 214928558 U * 11/2021
CN 214928559 U * 11/2021
CN 215321684 U * 12/2021

(Continued)

OTHER PUBLICATIONS

English translation of CN 203331659 U, publication date: Dec. 2013.*

(Continued)

*Primary Examiner* — Hwei-Siu C Payer

(57) ABSTRACT

Disclosed is a self-adaptive pencil feeding mechanism, including: a base, a first pencil feeding assembly, and a second pencil feeding assembly. The first pencil feeding assembly and the second pencil feeding assembly are mounted in the base and are capable of moving to the left or to the right, and the base is connected to a guiding member via an elastic member. The guiding member drives the first pencil feeding assembly and the second pencil feeding assembly to synchronously approach each other inwardly, and the first pencil feeding assembly and the second pencil feeding assembly, when a force caused by insertion of a pencil is applied thereto, are driven by a driving member to synchronously expand outwardly. The self-adaptive pencil feeding mechanism is capable of adapting to pencils of different diameters.

4 Claims, 2 Drawing Sheets

(56) References Cited

FOREIGN PATENT DOCUMENTS

| | | | |
|---|---|---|---|
| CN | 215321686 U | * | 12/2021 |
| CN | 215883138 U | * | 2/2022 |
| CN | 114103533 A | * | 3/2022 |

OTHER PUBLICATIONS

English translation of CN 204222500 U, publication date: Mar. 2015.*

* cited by examiner

SELF-ADAPTIVE PENCIL FEEDING MECHANISM

CROSS REFERENCE TO RELATED APPLICATIONS

The present application which claims the benefit of Chinese Patent Application No. 201922501256.1 filed on Dec. 31, 2019, the contents of which are incorporated herein by reference in their entirety.

FIELD OF THE INVENTION

The present disclosure relates to the technical field of stationery, and in particular, to a self-adaptive pencil feeding mechanism.

BACKGROUND OF THE INVENTION

At present, pencil sharpeners on the market are all provided with an automatic pencil feeding mechanism. The automatic pencil feeding mechanism for the pencil sharpeners is used for automatically feeding a pencil, and the performance of a pencil feeding device in a structure of a pencil sharpener directly affects the performance of the pencil sharpener.

Currently, an automatic pencil feeding mechanism for a pencil sharpener with the application number CN201721884313.3 is disclosed in existing technologies. The mechanism includes a first pencil feeding assembly, a second pencil feeding assembly and a turbine; the first pencil feeding assembly and/or the second pencil feeding assembly include/includes impellers/or an impeller; the turbine engages with the impellers and is a driving member, and the impellers are driven members; and the turbine rotates to drive the impellers to rotate. The automatic pencil feeding mechanism for a pencil sharpener is compact in structure, reliable in working, stable in transmission, high in efficiency, long in life, low in noise and capable of ensuring a constant transmission ratio.

However, there is still room for an improvement. For pencils of different sizes, the above mechanism cannot be adjusted freely to adapt to the pencils of different sizes. With respect to this problem, the inventor of the present disclosure develops the present application, i.e., a self-adaptive pencil feeding mechanism, so as to alleviate the problem in the existing technologies.

SUMMARY OF THE INVENTION

A technical problem to be solved by the present disclosure is to provide a self-adaptive pencil feeding mechanism which is capable of adapting to pencils of different diameters.

In order to solve the above technical problem, the present disclosure adopts the following technical solution. A self-adaptive pencil feeding mechanism includes a base, a first pencil feeding assembly, and a second pencil feeding assembly. The first pencil feeding assembly and the second pencil feeding assembly are mounted in the base and are capable of moving to the left or to the right, and the base is connected to a guiding member via an elastic member. The guiding member drives the first pencil feeding assembly and the second pencil feeding assembly to synchronously approach each other inwardly, and the first pencil feeding assembly and the second pencil feeding assembly, when a force caused by insertion of a pencil is applied thereto, are driven by a driving member to synchronously expand outwardly.

According to a preferred technical solution of the present disclosure, the base is provided at an inner wall thereof with lower notches having a top opening, and the first pencil feeding assembly and the second pencil feeding assembly are mounted in the lower notches via shafts, the shafts being capable of moving in the lower notches along a radical direction horizontally.

According to a preferred technical solution of the present disclosure, the guiding member is provided at a bottom thereof with upper notches which are provided over the lower notches to form mounting holes for receiving the shafts with the lower notches.

According to a preferred technical solution of the present disclosure, top surfaces of the upper notches are inclined surfaces which act on the shafts to drive the first pencil feeding assembly and the second pencil feeding assembly to close.

According to a preferred technical solution of the present disclosure, the guiding member is provided at an outer wall surface thereof with guide rails along a vertical direction, and the base is provided at an inner wall surface thereof with structures matching the guide rails; and the guiding member is capable of moving vertically along the guide rails.

According to a preferred technical solution of the present disclosure, the first pencil feeding assembly and the second pencil feeding assembly each include an impeller which is sleeved on the shaft, and the base is provided at an inner wall surface thereof with four lower notches which are disposed in left-right symmetry and in front-rear correspondence.

According to a preferred technical solution of the present disclosure, the guiding member is provided at the bottom thereof with four upper notches correspondingly, and two adjacent upper notches are disposed in left-right symmetry; and a top surface of each of the upper notches is an inclined surface, an inner side of which is higher than an outer side thereof.

According to a preferred technical solution of the present disclosure, the first pencil feeding assembly and the second pencil feeding assembly engage with the turbine, and the turbine rotates to drive the first pencil feeding assembly and the second pencil feeding assembly to rotate downwardly; and a pencil to be sharpened is inserted between the first pencil feeding assembly and the second pencil feeding assembly, and the first pencil feeding assembly and the second pencil feeding assembly which rotate downwardly drive feeding the pencil to be sharpened by extrusion.

Compared with existing technologies, the present disclosure is advantageous in that a movable connection manner is adopted for a first pencil feeding assembly, a second pencil feeding assembly and a base, so that the first pencil feeding assembly and the second pencil feeding assembly are capable of moving to the left or to the right so as to provide space for feeding of pencils having different diameters. The base is connected to a guiding member via an elastic member, and the guiding member connected to the elastic member drives the first pencil feeding assembly and the second pencil feeding assembly to approach each other. When no pencil is fed, the first pencil feeding assembly and the second pencil feeding assembly are in a closed state. When a pencil is fed into the pencil feeding assemblies, a force is applied to the first pencil feeding assembly and the second pencil feeding assembly, and the first pencil feeding assembly and the second pencil feeding assembly move synchronously under action of a driving member, so that a gap increases to a size large enough to receive the pencil. In addition, there is still a force that drives the first pencil feeding assembly and the second pencil feeding assembly to approach each other so as to fix the pencil fed in, which enables the self-adaptive pencil feeding mechanism provided by the present disclosure to automatically adapt to pencils of different diameters. After the pencil is taken out, the first pencil feeding assembly and the second pencil feeding assembly synchronously approach to each other again under action of the guiding member and return to original positions.

BRIEF DESCRIPTION OF THE DRAWINGS

The present disclosure will be described in detail below in conjunction with the accompanying drawings and preferred embodiments, but those persons of ordinary skill in the art shall appreciate that the accompanying drawings are drawn only for the purpose of illustrating the preferred embodiments and therefore shall not be construed as limiting the scope of the present disclosure. Also, unless otherwise specifically stated, the accompanying drawings are intended only for conceptually representing components or structures of objects being described and may contain exaggerated representations, and the accompanying drawings are not necessarily drawn to scale.

DETAILED DESCRIPTION OF THE EMBODIMENTS

The present disclosure will be described in detail below in conjunction with the accompanying drawings.

For a clearer understanding of the objective, technical solutions, and advantages of the present disclosure, a detailed description of the present disclosure is provided below in conjunction with the accompanying drawings and embodiments. It shall be appreciated that the specific embodiments described herein are only for the purpose of illustrating the present disclosure and are not intended for limiting the present disclosure.

Figure 1:
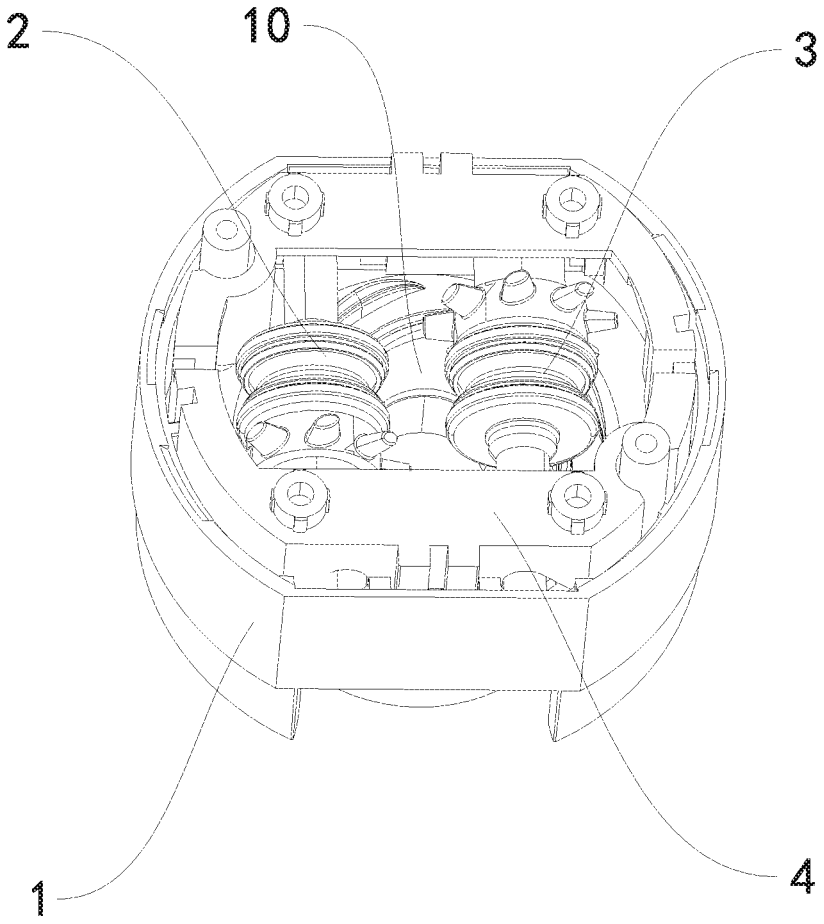
FIG. 1 is a schematic diagram showing a structure of a self-adaptive pencil feeding mechanism provided by the present disclosure.
Figure 2:
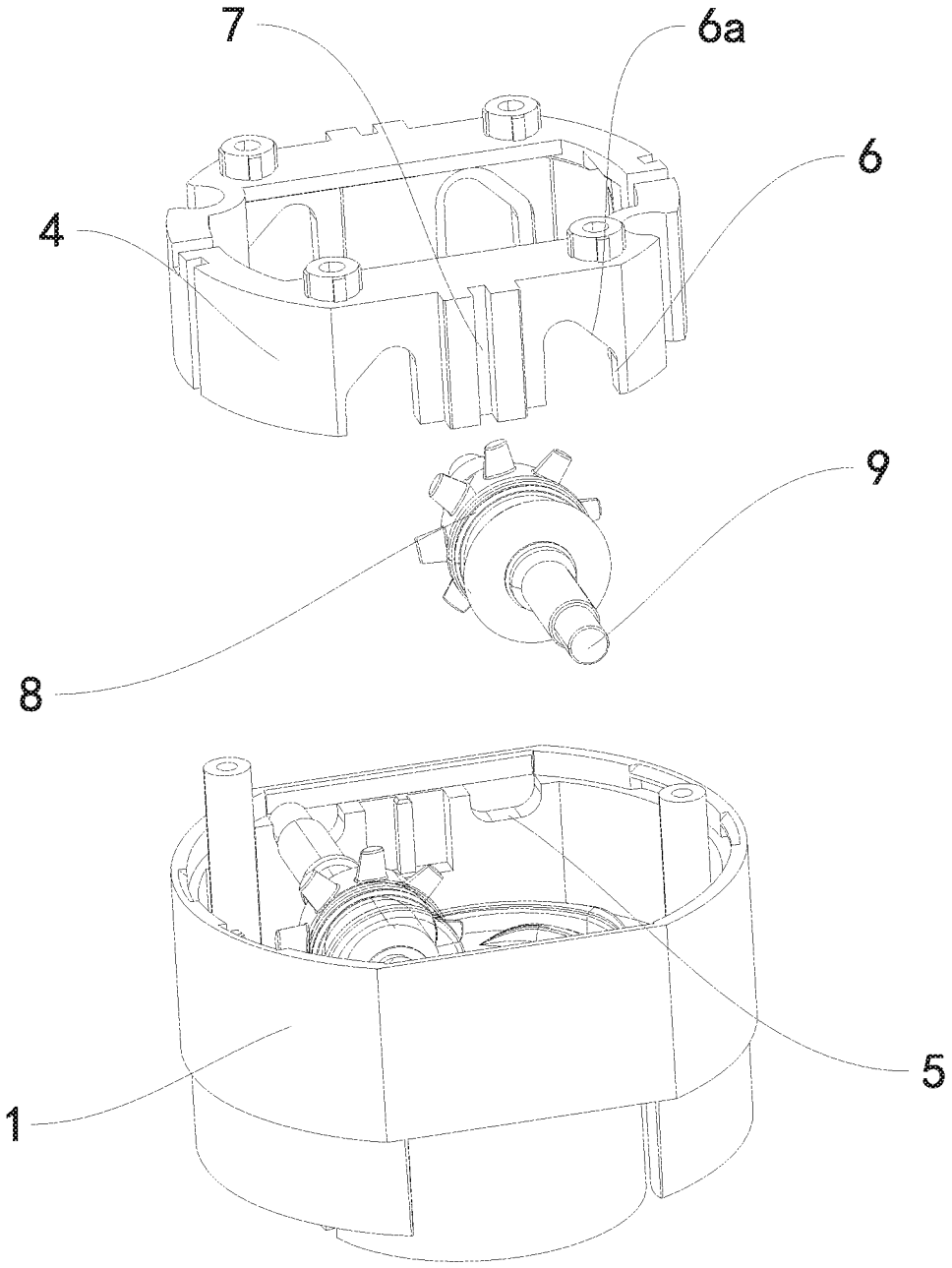
FIG. 2 is a schematic diagram showing an exploded structure of the self-adaptive pencil feeding mechanism provided by the present disclosure.

As shown in FIGS. 1 and 2, a self-adaptive pencil feeding mechanism is provided. The self-adaptive pencil feeding mechanism includes a base 1, a first pencil feeding assembly 2, and a second pencil feeding assembly 3. The first pencil feeding assembly 2 and the second pencil feeding assembly 3 are mounted in the base 1 and are capable of moving to the left or to the right, and the base 1 is connected to a guiding member 4 via an elastic member. The guiding member 4 drives the first pencil feeding assembly 2 and the second pencil feeding assembly 3 to synchronously approach each other inwardly, and the first pencil feeding assembly 2 and the second pencil feeding assembly 3, when a force caused by insertion of a pencil is applied thereto, are driven by the guiding member 4 to synchronously expand outwardly.

The base 1 is provided at an inner wall thereof with lower notches 5 having a top opening, and the first pencil feeding assembly 2 and the second pencil feeding assembly 3 are mounted in the lower notches 5 via shafts 9. The shafts 9 are capable of moving in the lower notches 5 along a radical direction horizontally. Both the first pencil feeding assembly 2 and the second pencil feeding assembly 3 of the present disclosure have a structure similar to a roller, are connected to the base 1 via the shafts 9, and rotate around the shafts 9 during operation.

The guiding member 4 is provided at a bottom thereof with upper notches 6 which are provided over the lower notches 5 to form mounting holes for receiving the shafts 9 with the lower notches 5.

Top surfaces of the upper notches 6 are inclined surfaces 6*a* which act on the shafts 9 to drive the first pencil feeding assembly 2 and the second pencil feeding assembly 3 to close. By means of the structural design of the upper notches 6, motion trips of vertical movements of the upper notches 6 are converted into a driving force for leftward and rightward movements of the first pencil feeding assembly 2 and the second pencil feeding assembly 3.

The guiding member 4 is provided at an outer wall surface thereof with guide rails 7 along a vertical direction, and the base 1 is provided at an inner wall surface thereof with structures matching the guide rails 7. The guiding member 4 is capable of moving vertically along the guide rails 7. A movement direction of the guiding member 4 is restricted by providing a structure of the guide rails 7, so that the entire structure is reliable and has high stability.

The first pencil feeding assembly 2 and the second pencil feeding assembly 3 each include an impeller 8 which is sleeved on the shaft 9. The base 1 is provided at the inner wall surface thereof with four lower notches 5 which are disposed in left-right symmetry and in front-rear correspondence. In the present disclosure, two lower notches 5 which are in front-rear correspondence are provided to mount the shaft 9 of the first pencil feeding assembly 2, and two lower notches 5 are provided to mount the shaft 9 of the second pencil feeding assembly 3.

The guiding member 4 is provided at the bottom thereof with four upper notches 6 correspondingly, and two adjacent upper notches 6 are disposed in left-right symmetry. A top surface of each of the upper notches 6 is an inclined surface 6*a*, an inner side of which is higher than an outer side thereof. Four upper notches 6 are in one-to-one correspondence to four lower notches 5.

The first pencil feeding assembly 2 and the second pencil feeding assembly 3 engage with the turbine 10, and the turbine 10 rotates to drive the first pencil feeding assembly 2 and the second pencil feeding assembly 3 to rotate downwardly. A pencil to be sharpened is inserted between the first pencil feeding assembly 2 and the second pencil feeding assembly 3, and the first pencil feeding assembly 2 and the second pencil feeding assembly 3 which rotate downwardly drive feeding of the pencil to be sharpened by extrusion.

In describing the self-adaptive pencil feeding mechanism of the present disclosure, it shall be noted that terms such as "center", "upper", "lower", "left", "right", "vertical", "horizontal", "inner", and "outer" and the like used for indicating orientations or positions are based on the orientations or positions shown in the accompanying drawings, and are used simply for facilitating and simplifying the description of the present disclosure rather than for indicating or suggesting that a device or an element being described must have a particular orientation or be configured and operated in a particular orientation. These terms therefore shall not be construed as limiting the present disclosure. Further, terms such as "first", "second", and "third" and the like are simply used for the purpose of description rather than for indicating or suggesting relative importance.

In describing the self-adaptive pencil feeding mechanism of the present disclosure, it shall be noted that unless otherwise expressly specified and defined, terms such as "mount", "connected to", "connect" and so on shall be interpreted in a broad sense. For example, "connection" can refer to a fixed connection, a detachable connection, or a one-piece connection, or can refer to a mechanical connection, or an electrical connection, or can refer to a direct connection, an indirect connection through an intermedium, or a communication between two elements. Those persons of ordinary skill in the art can interpret specific meanings of these terms used herein in the present disclosure based on specific situations.

The above is a detailed introduction to the present disclosure. Specific individual examples are used herein to illustrate the principles and embodiments of the present disclosure, but the description of the above embodiments is only provided for facilitating the understanding of the present disclosure and its core concepts. It shall be noted that those persons of ordinary skill in the art can make improvements and modifications to the present disclosure without departing from the principles of the present disclosure, and that those improvements and modifications shall also fall within the protection scope as defined in the claims of the present disclosure.

The invention claimed is:

1. A self-adaptive pencil feeding mechanism, comprising:

a base;

a first pencil feeding assembly; and a second pencil feeding assembly;

wherein the base is provided at an inner wall thereof with lower notches having a top opening, and the first pencil feeding assembly and the second pencil feeding assembly are mounted in the lower notches via shafts, the shafts being capable of moving inwardly or outwardly in the lower notches along a horizontal direction;

the base is connected to a guiding member, the guiding member is provided at a bottom thereof with upper notches which are provided over the lower notches to form mounting holes for receiving the shafts with the lower notches, top surfaces of the upper notches are inclined surfaces, an inner side of each of the top surfaces being higher than an outer side thereof, when no pencil is inserted, the inner side of each of the top surfaces abuts a corresponding one of the shafts to cause the first pencil feeding assembly and the second pencil feeding assembly to close to each other, the first pencil feeding assembly and the second pencil feeding assembly, when a force caused by insertion of a pencil is applied thereto, are driven by the force to synchronously move outwardly.

2. The self-adaptive pencil feeding mechanism according to claim 1, wherein the guiding member is provided at an outer wall surface thereof with guide rails along a vertical direction, and the base is provided at an inner wall surface thereof with structures matching the guide rails; and the guide rails are capable of moving along the structures.

3. The self-adaptive pencil feeding mechanism according to claim 1, wherein the first pencil feeding assembly and the second pencil feeding assembly each comprise an impeller which is sleeved on a respective one of the shafts, and the base is provided at an inner wall surface thereof with four of the lower notches which are disposed in left-right symmetry and in front-rear correspondence.

4. The self-adaptive pencil feeding mechanism according to claim 3, wherein the guiding member is provided at the bottom thereof with four of the upper notches correspondingly, and two adjacent upper notches of the four upper notches are disposed in left-right symmetry.

* * * * *